United States Patent [19]

Huish

[11] 4,010,509

[45] Mar. 8, 1977

[54] DOUBLE SULCUS TOOTHBRUSH

[76] Inventor: Frederic G. Huish, 3771 Ingraham St., San Diego, Calif. 92109

[22] Filed: Jan. 9, 1976

[21] Appl. No.: 647,998

Related U.S. Application Data

[63] Continuation-in-part of Ser. No. 635,245, Nov. 25, 1975, abandoned.

[52] U.S. Cl. ..... 15/167 R; 15/110

[51] Int. Cl.[2] ..... A46B 9/04

[58] Field of Search ..... 15/167 R, 167 A, 159 A, 15/110; 132/84 R

[56] References Cited

UNITED STATES PATENTS

| | | | |
|---|---|---|---|
| 3,722,020 | 3/1973 | Hills | 15/167 R |

FOREIGN PATENTS OR APPLICATIONS

| | | | |
|---|---|---|---|
| 1,057,279 | 10/1953 | France | 15/167 R |
| 1,100,290 | 3/1955 | France | 15/167 R |
| 919,224 | 10/1954 | Germany | 15/167 R |
| 128,951 | 12/1928 | Switzerland | 15/167 R |

*Primary Examiner*—Peter Feldman

[57] ABSTRACT

The invention is a double sulcus toothbrush having two groups of sulcus bristles which diverge at an angle relative to one another laterally of the toothbrush so that these groups may bear against the upper and lower teeth, inside or out, with the bristles entering the sulci at an angle appropriate for their cleansing, these bristles being optionally forwardly inclined, cut at a taper to facilitate brushing of the rear sulci or separated by a group of conventional bristles which are shorter than the sulcus bristles for brushing the crowns of the teeth.

1 Claim, 13 Drawing Figures

DOUBLE SULCUS TOOTHBRUSH

BACKGROUND OF THE INVENTION

The present application is a Continuation-in-Part of the application bearing the Ser. No. 635,245 having a filing date of Nov. 25, 1975, on a Double Sulcus toothbrush, now abandoned.

In recent years there has been an increased emphasis in periodontic aspect of dental hygiene resulting in the widespread popularity in the dental profession of the so-called sulcus toothbrush which has round tipped and relatively soft bristles and is used not in the repetitive brushing of the tooth surface but rather to engage between the tooth surface and gum at the gum crevice to remove particulates which have been lodged in this area. Because the sulcus toothbrush is relatively small and must be slowly moved and vibrated along the entire gum crevice, the process is very time consuming. Although various toothbrushes have been developed which brush more than one tooth surface at a time, no such toothbrush has been developed which is designed toward the particular needs of a gum crevice cleaning or sulcus brush.

SUMMARY OF THE INVENTION

The present invention is a double-acting sulcus toothbrush having two double rows of relatively long sulcus bristles which are spaced from one another and mutually divergent at an angle of about 30° so that at any position in the mouth, the upper and lower gum crevice may be cleansed simultaneously resulting in the reduction of brushing time by about half. Several rows of ordinary bristles may be incorporated in the toothbrush between the sulcus bristles which, to some extent, brush the sides of the teeth while the sulcus bristles clean the gum line, but their primary function is to enable the toothbrush to be effectively used to brush the crowns of the teeth as well as clean the gum line.

The sulcus bristles may be inclined forwardly relative to the toothbrush handle so that the sulci rearwardly disposed in the mouth may be reached and more effectively brushed, and for the same reason, the sulci bristles may be tapered toward the end of the toothbrush.

DETAILED DESCRIPTION OF THE PREFERRED EMBODIMENTS

Figure 1:
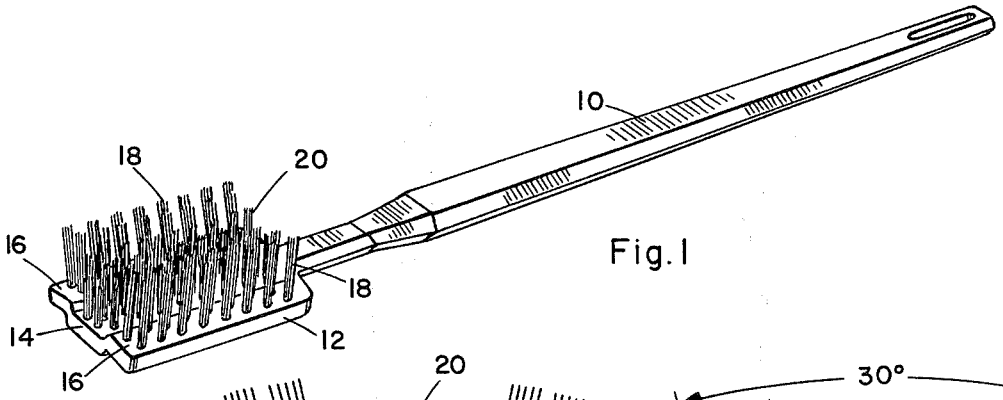
FIG. 1 is a perspective view of the toothbrush.
Figure 2:
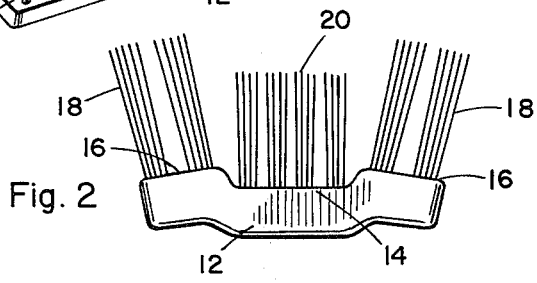
FIG. 2 is an end elevation view of the head of the brush shown in FIG. 1.

FIG. 1 provides an overall view of the toothbrush which has the usual handle 10 and a head 12 which supports the bristles. As can be seen in FIG. 2, the head of the embodiment of the toothbrush shown in FIG. 1 has a forward surface with a flat central area 14 and sloped shoulder 16, there being a group 18 of sulcus bristles embedded in each shoulder according to conventional techniques, with these bristle groups diverging relative to one another to define an angle of about 30°.

Figure 8:
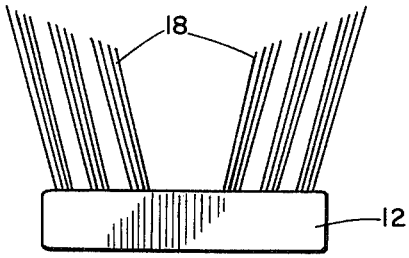
FIG. 8 is an end elevation of the head of a brush having the sulcus bristles alone.
Figure 13:
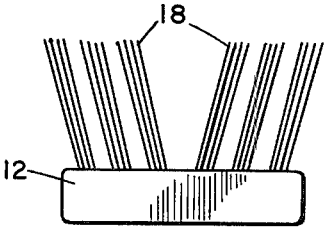
FIG. 13 is an end elevation view of a brush head in which the two sulcus bristle groups are closely spaced and the ends of the bristles define a plane.

The basic embodiments of the invention are illustrated in FIGS. 8 and 13 which show the two divergent sulcus bristle groups alone. The bristles in the brush illustrated in FIG. 13 are of generally equal length so that their ends define a plane. This embodiment would perhaps be more effective in brushing the sides of the teeth and the crevices therebetween simultaneously with the sulci. The bristles illustrated in FIG. 8 are V-cut and would also be effective to cleanse the sulci and tooth sides simultaneously.

Returning to FIG. 1, a group of ordinary bristles may be embedded in the flat rearwardly recessed central area 14 of the head which would be used primarily to brush the crown areas of the teeth although some brushing action against the teeth sides would be achieved while the sulci are being cleaned by the bristles 18. It will be noted that the sulcus bristles are significantly longer than the central so that the enamel at the gum line is not abraded.

In the embodiment of the invention shown in FIG. 2, the shoulder areas 16 of the head are displaced forwardly somewhat in the central area. The utility of this arrangement lies in the requirement that the sulcus bristles extend the increased distance to the sulci without interference with the central bristles 20 as can be understood from a glance at FIG. 5, which illustrates the toothbrush in use cleansing the gum crevices 22 surrounding upper and lower teeth 24 and 26, respectively. It can be seen that the sulcus bristles must extend up into the gum crevice and are also bent somewhat in use as illustrated, so that they should be longer than the central bristles. By molding the toothbrush with the shoulders 16 forwardly displaced, the sulcus bristles are provided with support closer to the brushing area.

Figure 4:
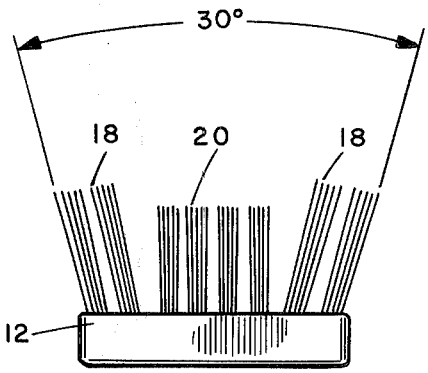
FIG. 4 is an end elevation view of a further head configuration indicating the angle between the sulcus group.
Figure 5:
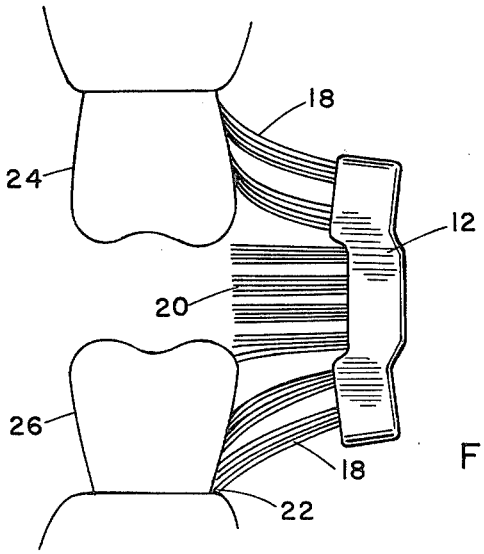
FIG. 5 illustrates the brush in use.

Another embodiment of the toothbrush is shown in FIG. 4, which is the simplest and probably the most economical to manufacture of the brushes having central bristles 20 because the head 12 is flat and similar to conventional toothbrushes. The angle of spread of the sulcus bristles is indicated to be 30°, which is close to the ideal angle and is characteristic of all the embodiments illustrated. It will be noted that in the illustration of the brushing operation shown in FIG. 5, the upper and lower teeth must be separated somewhat because of the wide stance of the sulcus bristles which would ordinarily be necessary if the central bristles 20 are included. Thus, as shown in FIG. 5, the central bristles touch only a small area of the side surfaces of the teeth, and as mentioned above, their primary function is to permit use of the toothbrush to clean the tooth crowns.

Figure 6:
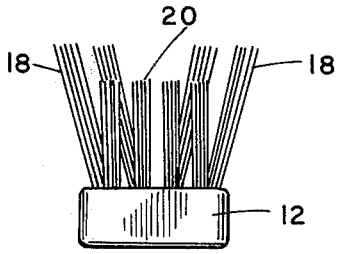
FIG. 6 is an end elevation of a further modification of the toothbrush head.
Figure 7:
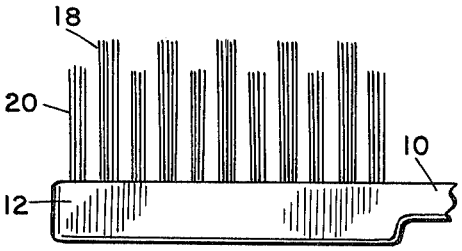
FIG. 7 is a side elevation of the toothbrush head illustrated in FIG. 6.

However, in a further modification of the bristle arrangement shown in FIGS. 6 and 7, the angulated sulcus bristles are actually rooted in the toothbrush head in the central toothbrush area so that the roots of the central bristles overlap those of the sulcus bristles. In this way, the distal ends of the sulcus bristles are brought closer together but retain the same angular relationship and it can be seen that the central bristles will be more effective in brushing the sides of the teeth while the sulcus bristles cleanse the gum line. To make this arrangement possible, it would of course be necessary to stagger in one way or another the lateral rows of sulcus bristles with the lateral rows of central bristles, as best seen in FIG. 7. Although perhaps more difficult to manufacture, the embodiment of FIGS. 6 and 7 have, in addition to the advantage of being able to brush the tooth sidewalls as well as the crowns, a definite size advantage which makes this version somewhat more appealing, especially to persons having relatively small mouths.

In the embodiment illustrated in FIG. 13 wherein the bristles are of substantially equal length and define a plane as previously mentioned, the side of the teeth may be brushed as well as sulci despite the absence of central bristles, although this embodiment would not be particularly adapted to brushing the crowns.

Figure 3:
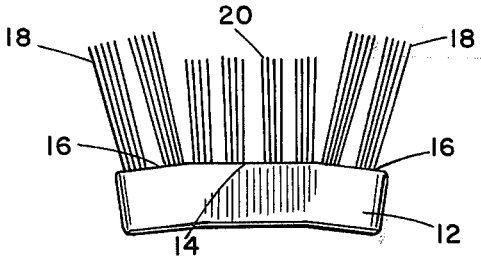
FIG. 3 is an end elevation view of an alternative head.
Figure 9:
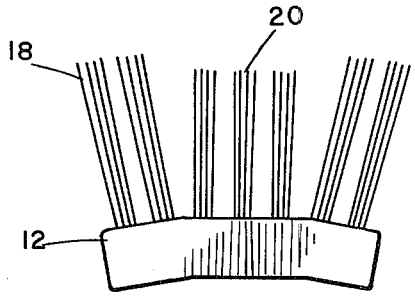
FIGS. 9 and 10 are end elevation views of heads of brushes similar to FIG. 3 but having different numbers of bristle rows.
Figure 10:
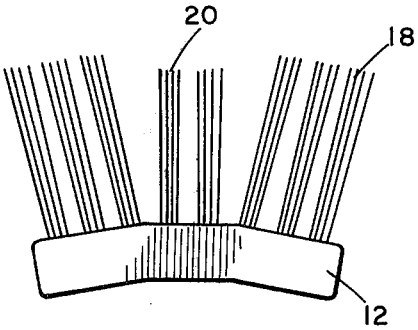
Figure 11:
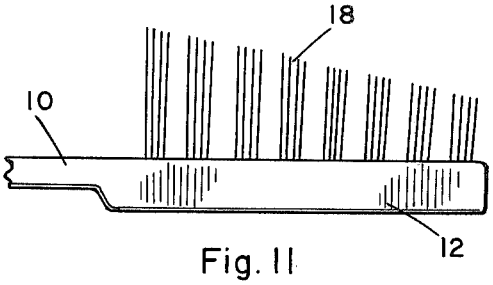
FIG. 11 is a side elevation of a toothbrush head, having tapered bristle groups.

FIGS. 9 and 10 illustrate embodiments which are very similar to that of FIG. 3 but have central and sulcus bristle groups which are provided in varying numbers of rows. FIG. 11 illustrates the concept of tapering the bristles toward the tip which could be applied to any of the other embodiments and has the clear advantage of permitting the toothbrush to fit into the rearmost reaches of the mouth, and particularly on the outside of the teeth where space is often a problem.

Figure 12:
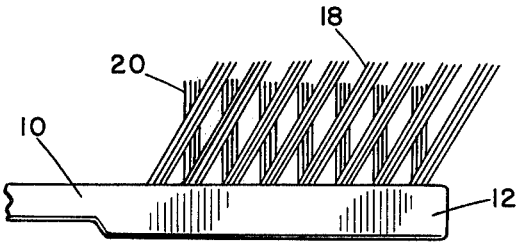
FIG. 12 is a side elevation view of a modified toothbrush head having the sulcus bristles thereof forwardly inclined.

In FIG. 12, the sulcus bristles are shown as forwardly angulated, again to facilitate the brushing of the rearmost sulci. These angulated bristles could of course be used with or without the central bristle group 20 and overcome in part the problem of the toothbrush head being blocked against the sides of the mouth and preventing effective cleansing of difficult to reach areas. This embodiment would be particularly useful in brushing the sulci around and behind the wisdom teeth because of their relatively long reach.

In all of these disclosed embodiments, the toothbrush is effective in cleansing both upper and lower gum crevices in all parts of the mouth including the lingual side of the teeth and both sides of the front teeth, so that clearly the entire mouth can be brushed in approximately half the time required using a conventional sulcus toothbrush. Additionally, the brush is very effective in cleansing the tooth area around orthodontal braces, and because the angulated bristles establish almost automatically the proper angle of the bristles relative to the sulcus area, the brush is very easy to use properly and is especially effective for use by children.

I claim

1. A double-acting sulcus toothbrush comprising:

a. an elongated handle;

b. a head integral with one end of said handle and having a forward face;

c. an elongated, central bristle group longitudinally extended on said face;

d. two longitudinally extended elongated sulcus bristle groups embedded in the forwarded face of said head on opposite sides of said central bristle group the bristles of said sulcus bristle groups being mutually divergent and having ends extending forwardly beyond the bristles of said central bristle group.

e. the forward face of said head having a flat central area and two rearwardly sloped lateral shoulders;

f. said central bristles being embedded in said central area and said sulcus bristles being embedded generally orthogonally into said shoulders, said flat central area being rearwardly recessed relative to said shoulders.

* * * * *